United States Patent [19]

Yen

[11] 4,404,558

[45] Sep. 13, 1983

[54] ELECTRICAL CONTROL CIRCUIT FOR OPERATING A GARAGE DOOR OR SIMILAR DEVICE

[76] Inventor: Anderson Yen, 4011 Cranford Cir., San Jose, Calif. 95124

[21] Appl. No.: 254,453

[22] Filed: Apr. 15, 1981

[51] Int. Cl.[3] ..... G08C 19/00

[52] U.S. Cl. ..... 340/825.72; 340/825.69; 340/825.71; 340/696; 318/285; 318/466

[58] Field of Search ..... 340/825.72, 825.69, 340/825.71, 51, 696, 825.73, 825.74, 825.75, 825.76; 49/25; 318/282, 466, 467–469, 285

[56] References Cited

U.S. PATENT DOCUMENTS

| | | | |
|---|---|---|---|
| Re. 29,525 | 1/1978 | Willmott | 340/696 |
| 2,588,879 | 3/1952 | Richards | 340/51 UX |
| 3,349,559 | 10/1967 | Gloor | 60/62.5 |
| 3,396,252 | 8/1968 | Serizawa et al. | 200/86 |
| 3,445,848 | 5/1969 | Goldstein | 340/825.72 |
| 3,604,005 | 9/1971 | Gilmore | 340/825.69 |
| 3,608,242 | 9/1971 | Braun | 49/280 |
| 3,783,556 | 1/1974 | Cook | 49/25 |
| 4,013,851 | 3/1977 | Abbondante | 200/86 R |
| 4,129,212 | 4/1979 | Willach | 361/172 |
| 4,207,555 | 6/1980 | Trombly | 340/147 MD |
| 4,232,354 | 11/1980 | Mueller et al. | 361/171 |

OTHER PUBLICATIONS

Popular Science, Nov. 1980, "Electronic Garage Lock You Can Build in 30 Minutes," by Chris Propst, p. 121.

Stanley Vemco Manual Deluxe Residential Garage Door Opener.

Sears, Roebuck and Company Advertisement, Sears Best Garage Door Opener.

Chamberlain Manufacturing Corp. Electro Lift, Owners Manual Automatic Garage Door Opener.

Alliance Manufacturing Co., Inc. Advertisement, Genie GS-459.

*Primary Examiner*—Donnie L. Crosland

*Attorney, Agent, or Firm*—Jack M. Wiseman

[57] ABSTRACT

A circuit for controlling an electrically operated garage door comprising a manually operated switch disposed within the garage. By actuating the manually operated switch twice within a prescribed period of time, the garage door is either opened or closed depending on its state. For automatically closing the garage door, a tape switch is disposed on the garage floor in the vicinity of a garage door. The tape switch extends across the garage floor in a direction to be actuated by the front and rear wheels of the vehicle. When a vehicle leaves the garage or has entered the garage, the successive actuations of the tape switch by two sets of wheels complete an operating circuit to close the garage door. The garage door is also opened by the manual operation of a digit selecting switch and a digit sequencing switch which are located outside of the garage. A preselected code is stored in a code circuit by a set of presettable mechanical switches representing the respective digits of the code. The digit selecting switch and the digit sequencing switch are operated to present various digits for comparison with the digits of the preselected code. Should the digits presented by the digit selection switch match the digits of the presented code, the garage door will open.

25 Claims, 5 Drawing Figures

ELECTRICAL CONTROL CIRCUIT FOR OPERATING A GARAGE DOOR OR SIMILAR DEVICE

BACKGROUND OF THE INVENTION

The present invention relates in general to an electrical control circuit, and more particularly to a control circuit for an electrically operated garage door or the like.

Presently, garage door openers include remote control units (transmitter and receiver), wall push-button switches, and outdoor wall key switches. Stanley Vemco of Madison Heights, Mich., manufactures and sells a garage door opener that includes a radio receiver and a transmitter. A pushbutton is actuated manually for opening and closing the garage door. Sears, Roebuck and Company of Chicago, Ill., has sold a garage door opener in which a transmitter button controls the opening and closing of a garage door, and a digital code is selected for controlling the opening and closing of a garage door. Chamberlain Manufacturing Corporation of Elmhurst, Ill., manufactures and sells an automatic garage door opener that employs a radio receiver, transmitter and push button for controlling the opening and closing of garage doors. The Alliance Manufacturing Co., Inc. of Alliance, Ohio, manufactures and sells a garage door opener in which the transmitter button is actuated once to open the garage door and twice to close the garage door.

In the November 1980 issue of Popular Science is an article entitled "Electronic Garage Lock You Can Build In 30 Minutes" by Chris Propst, page 121, in which there is disclosed an electrical push button lock for a garage door in which the door opens only when active buttons are actuated simultaneously.

The patent to Gloor, U.S. Pat. No. 3,349,559, issued on Oct. 31, 1967, for Foor-Operating Apparatus discloses a pneumatic carpet placed in front of a door. The pneumatic carpet includes a chamber that has a pressure responsive diaphragm. When the carpet is walked on, the pressure responsive diaphragm actuates a pneumatic switch to control an electrical circuit for the opening of a door.

In the patent to Cook, U.S. Pat. No. 3,783,556, issued on Jan. 8, 1974, for Door Control System Providing Automatic Delayed Door Reversal, there is disclosed a treadle switch operated in response to a vehicle travelling over a hose. The treadle switch operates a relay to initiate a door opening cycle. The system also employs manually operated switches. Several of the switches are manually operated to close the door or to open the door. In addition, the system employs delay circuits and delay relays. The patent to Cook also discloses both the use of a treadle switch and a photocell. The treadle switch is operated by the movement of a vehicle thereover and the photocell changes its state in response to the movement of the vehicle interrupting the light beam. The garage door closes following the actuation of the treadle and the garage door closes when the photocell reacts to the movement of the vehicle.

As for the patent to Abbondante, U.S. Pat. No. 4,013,851, issued on Mar. 22, 1977, for Vehicle Detection Apparatus, it discloses a tire ramp with elongated electrical switching sensors. Movement of a tire over the ramp results in the actuation of the electrical switches.

In the patent to Serizawa et al., U.S. Pat. No. 3,396,252, issued on Aug. 6, 1968, for Electrical Surface Switch Having Improved Bias Means, there is disclosed an electrical surface switch comprising overlying flexible contact sheets made of conductive material. The sheets are normally biased away from one another by resilient fibers. When an applied force brings the spaced apart sheets in contact with one another, electrical connections are made.

The patent to Mueller et al., U.S. Pat. No. 4,232,354, issued on Nov. 4, 1980, for Electrically Actuated Lock For A Door Or Similar Access Means discloses a door unlocking arrangement in which a multiple number of data bits are introduced in a given sequence into a plurality of series connected flip-flop circuits. Each flip-flop circuit is operable one at a time and in sequence to cause the unlatching of a door. The application of a coded arrangement for a garage door opener is suggested in the above-cited publication of Popular Science, November 1980.

The patent to Willach, U.S. Pat. No. 4,129,212, issued on Apr. 10, 1979, for Electrically Encoded, Electrically Controlled Push-Button Combination Lock discloses an encoding circuit for the energization of an unlocking solenoid. The circuit includes a memory for storing the code. A comparison circuit is connected to the memory to compare a series of switch operation of selected binary words with the stored code of binary words. If there is a match, the unlocking solenoid is energized.

Other patents of interest are:

Braun, U.S. Pat. No. 3,608,242, issued on Sept. 28, 1971 for Door-Operating Mechanism;

Trombly, U.S. Pat. No. 4,207,555, issued on June 10, 1980 for Lock System.

SUMMARY OF THE INVENTION

Electrical circuit for controlling the operation of a garage door in which the garage door is closed by the front and rear wheels of a vehicle within a prescribed time interval.

Electrical circuit for controlling the operation of a garage door in which the garage door is opened with the matching of a preselected digital code of a circuit by the actuation of a digit selecting switch and a digit sequencing switch. The digit selecting switch and the digit sequencing switch are operated to present various digits for comparison with the preselected code of the circuit.

A feature of the present invention is the facility and ease of use of the control switches by an operator and, yet, the system lends itself to reduced costs.

Another feature of the present invention is safety and security. The garage door does not close until the vehicle is in the garage. A two-step operation is employed for closing the garage door in response to the movement of the vehicle. Thus, the front wheels and the rear wheels must ride over the tape switch within a prescribed period of time to close the garage door. Two vehicles moving in unison will not result in the closing of the garage door.

In the switching circuit of the present invention, there is a delayed action in the closing of the garage door between the time of the manual actuation of the switch and the movement of the garage door to give the operator ample time to leave the garage before the garage door starts the downward movement.

Another feature of the present invention is to obviate the need of a key to open the garage door and, yet, the security of the home is improved by the employment of the digit selecting switch and the digit sequencing switch which affords a digit-by-digit comparison with a preselected digital code in a code circuit.

DESCRIPTION OF THE PREFERRED EMBODIMENT

Figure 1:
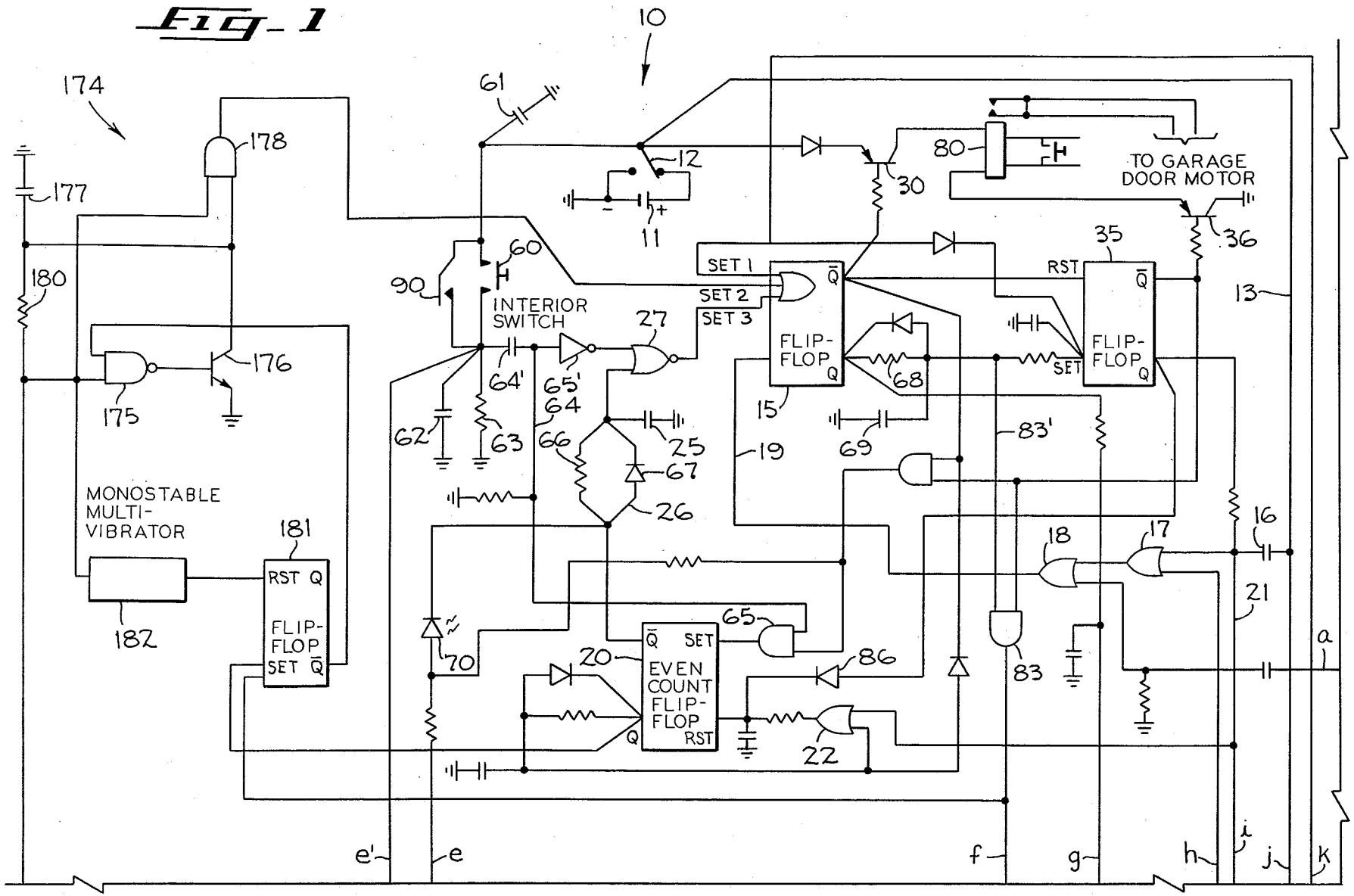
FIGS. 1–4 when arranged as shown in FIG. 5 are a schematic diagram of a circuit embodying the present invention for controlling the operation of an electrically operated garage door.
Figure 5:
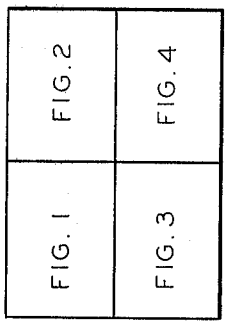
Figure 2:
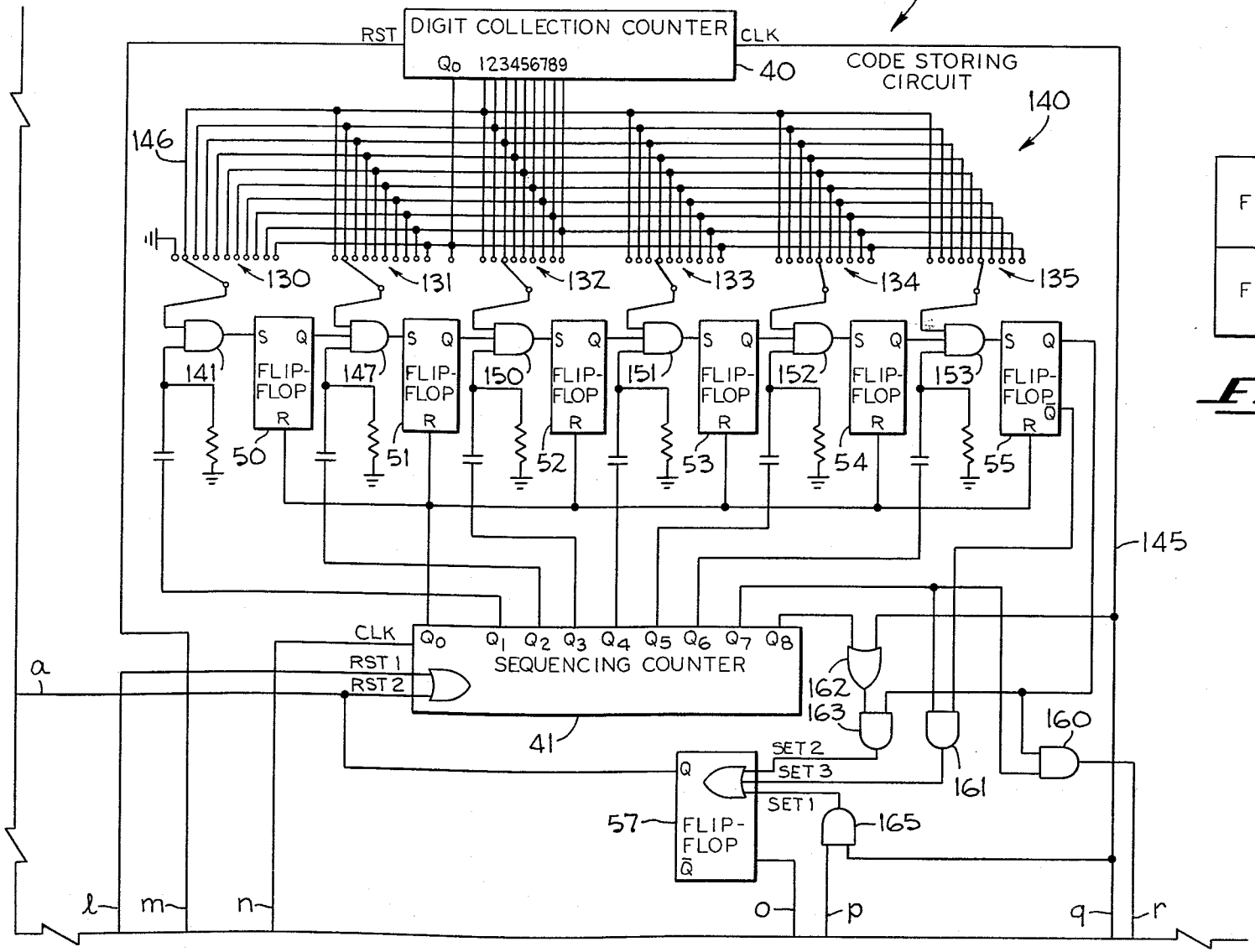
Figure 3:
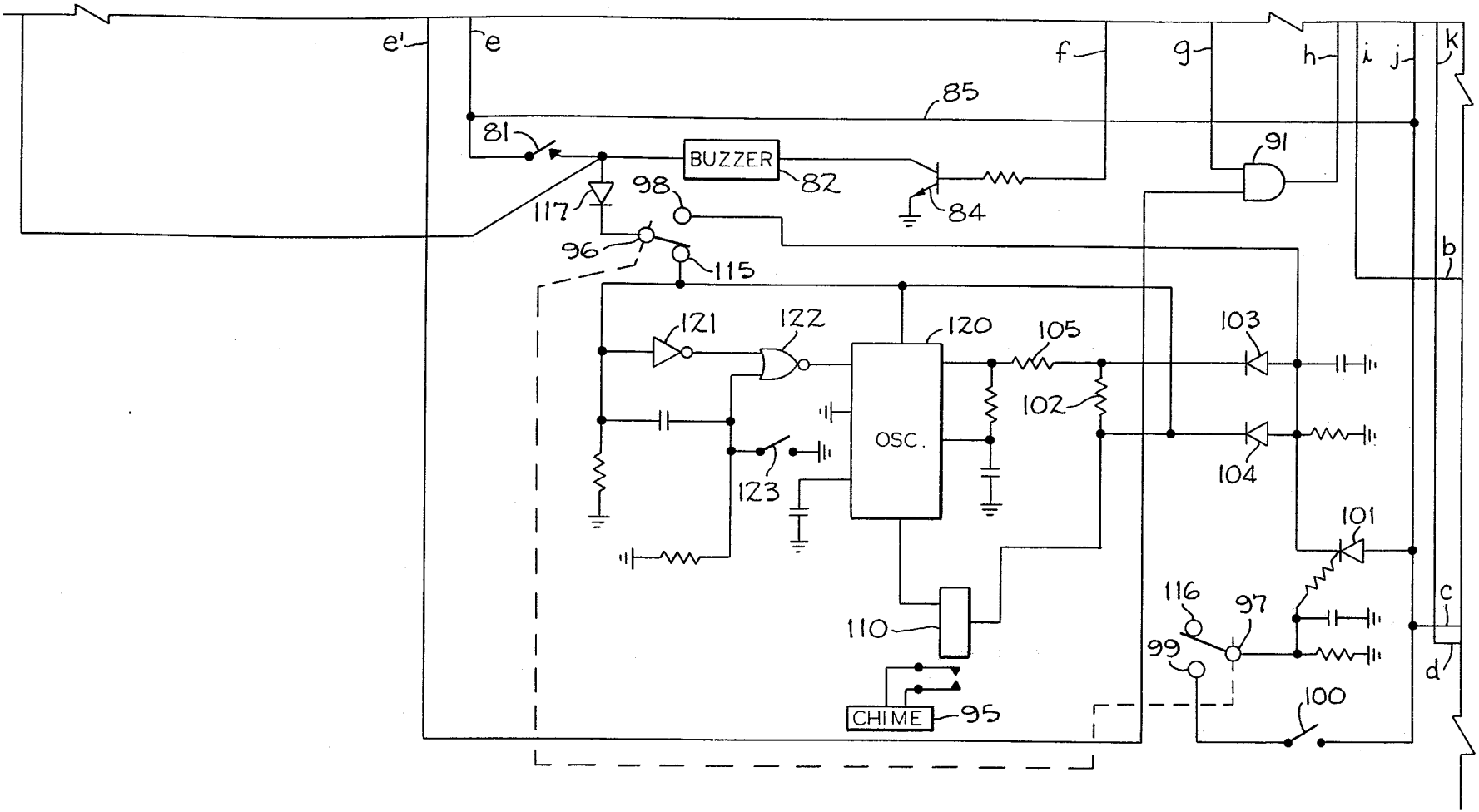
Figure 4:
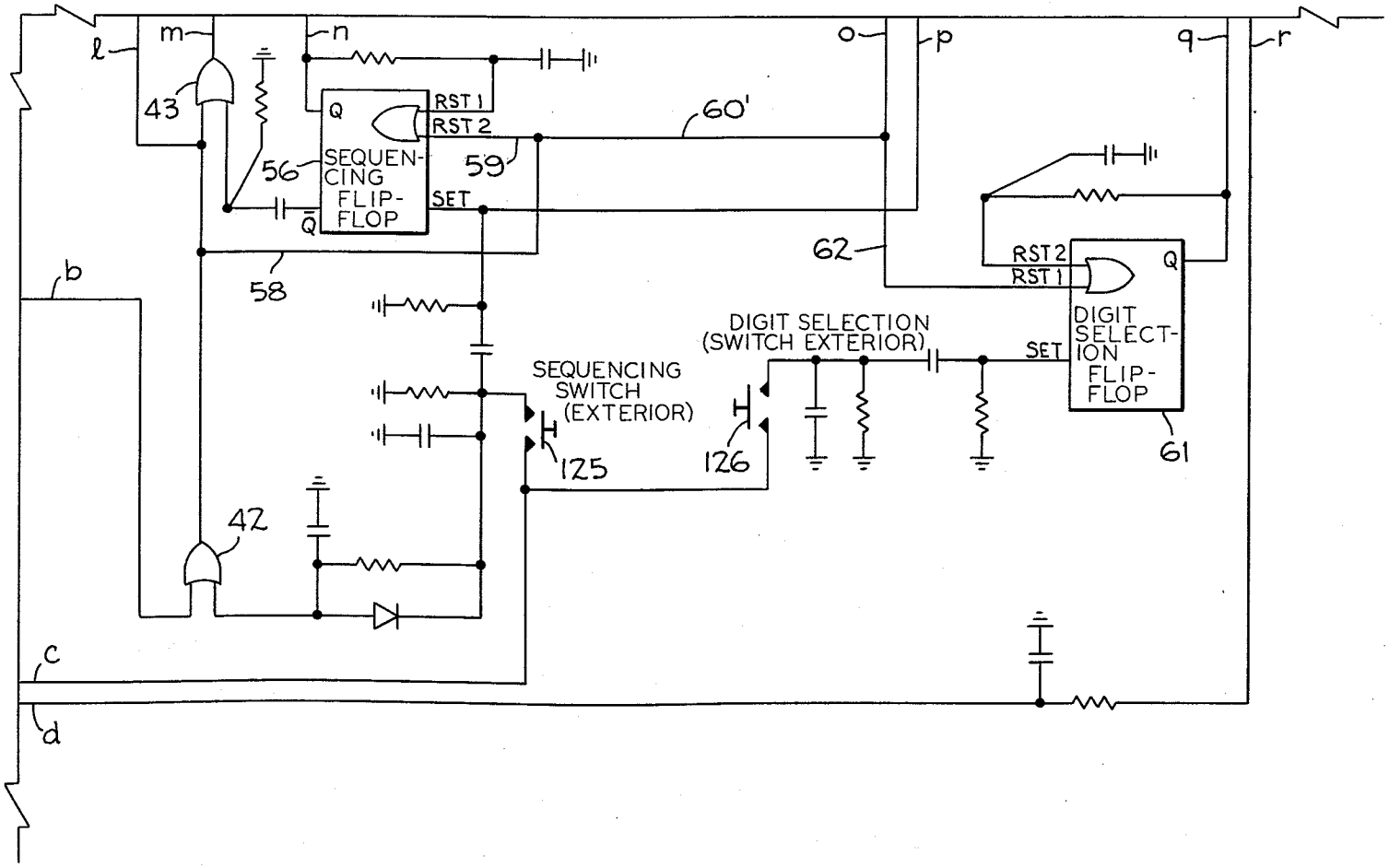

Illustrated in FIGS. 1–4 is a circuit 10 for controlling the operation of an electrically operated garage door, not shown. The circuit 10 comprises a suitable source of power, such as a battery 11 (FIG. 1). When an on-off switch 12 is actuated to establish a connection with the positive side of the battery 11, the circuit 10 is conditioned to control the reset operation. The actuation of the on-off switch 12 to the positive side of the battery 11 places a positive voltage on a conductor 13. This action generates a reset pulse to reset a flip-flop circuit 15 through capacitor 16, OR gate 17, OR gate 18 and over a conductor 19. Similarly, a reset pulse is generated to reset a flip-flop circuit 20 over a path including the conductor 13, the capacitor 16, a conductor 21 and OR gate 22.

When the power is turned on by the actuation of the on-off switch 12, a capacitor 25 is charged over a path including a resistor-diode network 26 and the output terminal $\overline{Q}$ of the flip-flop 20, which is in a reset state. When the capacitor 25 is charged, a NOR gate 27 is disabled to inhibit the setting of the flip-flop circuit 15 to state 2. Under this condition, a transistor 30 is off and non-conducting. In addition thereto, a flip-flop 35 is reset from the $\overline{Q}$ terminal of the flip-flop 15. With the flip-flop circuit 35 in a reset state, a transistor 36 is turned off and non-conducting from the $\overline{Q}$ terminal of the flip-flop 35.

At the time of turning the power on through the actuation of the switch 12, a reset pulse resets a digit selection counter 40 (FIG. 2) over the following path: conductor 13, capacitor 16, conductor 21, conductor i, conductor b, OR gate 42, OR gate 43, and conductor m. In a similar manner, a sequencing counter circuit 41 is reset to state 1 over the following path: conductor 13, capacitor 16, conductor 21, conductor i, conductor b, OR gate 42, conductor 1 and sequencing counter 41. The reset of the sequencing counter 41 to state 1 returns the counter 41 to an output voltage at its terminal $Q_0$ and the reset of the counter 40 returns its output voltage to terminal $Q_0$. No output voltage appears on the terminals $Q_1$–$Q_8$ of the counter 41 and no output voltage appears on the terminals $Q_1$–$Q_9$ of the counter 40.

By resetting the sequencing counter 41 to state 2, flip-flop circuits 50-55 are reset. A sequencing flip-flop 56 (FIG. 4) is reset to state 2 and a flip-flop 57 is reset over the following path: conductor 13 (FIG. 1), capacitor 16, conductor 21, conductor i, conductor b, OR gate 42, conductor 58, and conductors 59 and 60'. Similarly, a digit selection flip-flop circuit 61 (FIG. 4), is reset to state 1 over the following path: conductor 13, capacitor 16, conductor 21, conductor i, conductor b, OR gate 42, conductor 58, conductor 60' and conductor 62.

To manually open or close the garage door from the interior of the garage, a switch 60 (FIG. 1) is located inside of the garage. A capacitor 61 charges when the ON-OFF switch 12 is moved to the power ON position. Each time the switch 60 is manually operated, a pulse is emitted by discharging the capacitor 62 over a path including resistor 63 and ground. The pulse advances through a capacitor 64' and also is applied to one side of the NOR gate 27 through an inverter 65'. The pulse is also emitted over a conductor 64 and causes an AND gate 65 to conduct. As a result thereof, the even count flip-flop 20 is set. Each reset state of the even count flip-flop 20 emits a pulse from the $\overline{Q}$ terminal thereof through the resistor-diode network 26 to charge the capacitor 25. A resistor 66 of the network 26 and the capacitor 26 form a R-C time delay circuit. A diode 67 of the network 26 is for the rapid charge of the capacitor 25. After the capacitor 25 discharges to cause the NOR gate 27 to conduct, the flip-flop 15 is set by a positive pulse through the NOR gate 27 by a succeeding pulse from the actuation of the switch 60.

In the opening and closing of the garage door, the switch 60 must be actuated twice or an even number of times within a predetermined time period. The predetermined time period is selected by the R-C time delay circuit of the resistor 66 and the capacitor 25. It is the discharging of the capacitor 25 to a predetermined magnitude that causes the NOR gate 27 to conduct. Thus, if an even number of pulses occur during the time period set by the R-C time delay circuit of resistor 66 and capacitor 25, the flip-flop circuit 20 will allow a single pulse to be applied to the flip-flop circuit 15 via the NOR gate 27 and the resistance-diode network 26.

The flip-flop circuit 15 changes its state to cause the transistor 30 to conduct and to cause the flip-flop circuit 35 to change its state. Through a resistor 68 and a capacitor 69, the flip-flop circuit 35 changes its state to cause the transistor 36 to conduct. The conduction of the transistors 30 and 36 energizes a slow operating relay 80. The contacts of the relay 80 close to operate a reversible motor, not shown, to open and close the garage door. If the garage door is opened, the closing of the contacts of the relay 80 will cause the motor to close the garage door. Conversely, if the garage door is closed, the closing of the contacts relay 80 will cause the motor to open the garage door. The reversible motor is of the type manufactured by Alliance Electro Lift, as Model GS 450 or G-6446.

If a switch 81 (FIG. 3) is closed, a buzzer 82 will operate to alert an operator of the opening or closing of the garage door. The flip-flop 15 (FIG. 1) causes an AND gate 83 to conduct via a conductor 83'. The conduction of the AND gate 83 causes a transistor 84 (FIG. 3) to conduct. The other side of the buzzer 82 is completed electrically through the switch 81, conductor 85, conductor j, conductor 13, switch 12 and battery 11.

The change of state of the flip-flop 35 resets the flip-flop 20 through its terminal Q, diode 86 and reset terminal of the flip-flop 20. The flip-flop 15 is reset over the path including terminal Q of the flip-flop 35, OR gate 17, OR gate 18 and conductor 19. The resetting of the flip-flop 15 causes the transistor 30 to become non-conducting through the positive voltage on the $\overline{Q}$ terminal thereof. The resetting of the flip-flop 35 causes the transistor 36 to become non-conducting through the positive voltage on the $\overline{Q}$ terminal thereof.

To close the garage door automatically, a tape switch 90 (FIG. 1) is disposed on the garage door floor in the vicinity of the garage door when closed. The tape switch 90 is of the type manufactured by Tape Switch Corp. as model RBMA 171-IS. The tape switch 90 extends across the garage floor in a direction to be actuated by the front and rear wheels of the vehicle. When a vehicle leaves the garage or when a vehicle enters the garage, the successive actuation of the tape switch 90 by two sets of wheels within the predetermined period of time energizes the slow operating relay 80 in a manner theretofore described in connection with the manually operated switch 60. The tape switch 90 is in parallel with the manually operated switch 60.

Should it be desired that the garage door not close, then the vehicle is moved so that only one set of wheels actuates the tape switch 90. If the predetermined time period has elapsed before a second set of wheels actuates the tape switch 90, the relay 80 will not operate to close the garage door. The predetermined time period is determined by the R-C time delay circuit of resistor 66 and capacitor 25. In order to operate the relay 80 through the tape switch 90, the tape switch 90 must be actuated an even number of times during the predetermined time interval. It is the even count AND gate 91 that inhibits the control operation when an odd number of pulses is emitted and enables the control operation when an even number of pulses is emitted.

For anti-theft purposes, a chime 95 is provided. To set the anti-theft alarm, switches 96 and 97 are actuated to contact positions 98 and 99, respectively. Mounted on the garage door is a suitable magnetic read switch 100 that closes as the garage door is opened. Similarly, the switch 81 may optionally be closed when the garage door closes. The actuation of either switch to the closed position will cause a silicon controlled rectifier 101 to conduct. The conduction of the silicon controlled rectifier 101 causes current to flow through diodes 103 and 104 to short out a resistor 102. Current flow through a resistor 105 applies an operating voltage to a 555 oscillator 120 for producing high frequency signals. In so doing, a relay 110 is energized by the high frequency signals to operate a suitable alarm, such as chime 95.

If the switches 96 and 97 are actuated to engage contacts 115 and 116, respectively, the 555 oscillator 120 will produce low frequency signals. The closing of switch 81 causes a signal to advance through a diode 117, contact 96, contact 115, resistor 102, resistor 105 and the 555 oscillator 120. The voltage through the diode 117 is also applied through contact 96, contact 115, inverter 121, NOR gate 122 and to the 555 oscillator 120 to generate a relatively low frequency sound by the operation of the relay 110. The relay 110 is of the type manufactured by Elec-Trol, Model RA 31451051. A switch 123 is employed for obviating the need for the optional switch 81.

To manually open the garage door from a location outside of the garage, a digit selection switch 126 (FIG. 4) and a digit sequencing switch 125 are mounted on an exterior wall of the garage. Let us assume that the preselected code for opening the garage door is a six digit code and let us further assume that the code is 1-2-3-4-5-6. The code to be matched for opening the garage door is preselected by presettable switches 130–135 (FIG. 2) of a code storing circuit 140. The switches 130–135 may be considered as a means for storing a code. The switch 130 preselects the first digit of the code; the switch 131 preselects the second digit of the code; the switch 132 preselects the third digit of the code; the switch 133 preselects the fourth digit of the code; the switch 134 preselects the fifth digit of the code; and the switch 135 preselects the sixth digit of the code.

In order to preset the switches 130–135, the wipers of the switches 130–135 are moved into engagement, respectively, with designated contacts that correspond to the digits of the preselected code. Under the assumed circumstances, the wiper of the switch 130 engages the contact 1 of the switch 130; the wiper of the switch 131 engages the contact 2 of the switch 131; the wiper of the switch 132 engages the contact 3 of the switch 132; the wiper of the switch 133 engages the contact 4 of the switch 133; the wiper of the switch 134 engages the contact 5 of the switch 134; and the wiper of the switch 135 engages the contact 6 of the switch 136.

Initially, an operator actuates the digit selection switch 126 (FIG. 4) once for the digit 1. This action changes the state of the digit selection flip-flop 6. In turn, the digit selection flip-flop 61 produces a pulse over a conductor 145 to step the digit selection counter 40 (FIG. 2) from the terminal $Q_0$ to the terminal $Q_1$. Thereupon, the digit selection counter 40 prepares an AND gate 141 for conduction. Now, the sequencing switch 125 (FIG. 4) is actuated. The actuation of the sequencing switch 125 changes the state of the sequencing flip-flop 56. The changing of the state of the sequencing flip-flop 56 produces a pulse over a conductor n to advance the sequencing counter 41 (FIG. 2) from the terminal $Q_0$ to the terminal $Q_1$. Now, the AND gate 141 conducts to change the state of the flip-flop 50. The conduction of the flip-flop 50 applies a voltage to one of the terminals of an AND gate 147. If the digit selection counter were pulsed more than once, the AND gate 141 would not conduct and the garage door would not open. The $\overline{Q}$ output of the sequencing flip-flop 56 resets the digit selection counter 40 to the $Q_0$ output over the conductor m.

The operator now actuates the digit selection switch 126 twice for the digit 2. The actuation of the digit selection switch 126 twice changes the state of the digit selection flip-flop 61 twice. This action produces two pulses which are emitted over a conductor 145 to advance the digit selection counter 40 from the output terminal $Q_0$ to the output terminal $Q_2$. In so doing, a voltage is emitted through a matrix 146 and through a wiper of the switch 131 and is applied to an input terminal of the AND gate 147. The change of state of the flip-flop 50 applied a voltage to another input terminal of the AND gate 147. Now, the operator actuates the sequencing switch 125. This action changes the state of the sequencing flip-flop 56. In turn, the sequencing flip-flop 56 produces a pulse for conduction over the conductor n, which results in the sequencing counter 41 advancing from the output terminal $Q_1$ to the output terminal $Q_2$. In so doing, a voltage is applied to still another terminal of the AND gate 147 to cause the conduction of the AND gate 147. The conduction of the AND gate 147 changes the state of the flip-flop 51. The change of state of the flip-flop 51 applies a voltage to an input of an AND gate 150. If the operator had actuated the digit selection switch 126 a number of times other than twice, the AND gate 147 would not conduct and the flip-flop circuit 51 would not change its state. Consequently, the garage door would not open. A reset pulse is emitted by the sequencing flip-flop 56 through the OR gate 43 and over the conductor m to reset the digit selection counter 40 and return it to the $Q_0$ terminal.

The operator now actuates the digit selection switch 126 three times for the digit 3. The actuation of the digit selection switch 126 three times changes the state of the digit selection flip-flop 61 three times. This action produces three pulses which are emitted over a conductor 145 to advance the digit selection counter 40 from the output terminal $Q_0$ to the output terminal $Q_3$. In so doing, a voltage is emitted through a matrix 146 and through a wiper of the switch 132 and is applied to an input terminal of the AND gate 150. The change of state of the flip-flop 51 applied a voltage to another input terminal of the AND gate 150. Now, the operator actuates the sequencing switch 125. This action changes the state of the sequencing flip-flop 56. In turn, the sequencing flip-flop 56 produces a pulse for conduction over the conductor n, which results in the sequencing counter 41 advancing from the output terminal $Q_2$ to the output terminal $Q_3$. In so doing, a voltage is applied to still another terminal of the AND gate 150 to cause the conduction of the AND gate 150. The conduction of the AND gate 150 changes the state of the flop-flop 52. The change of state of the flip-flop 52 applied a voltage to an input of an AND gate 151. If the operator had actuated the digit selection switch 126 a number of times other than three times, the AND gate 150 would not conduct and the flip-flop circuit 52 would not change its state. Consequently, the garage door would not open. A reset pulse is emitted by the sequencing flip-flop 56 through the OR gate 43 and over the conductor m to reset the digit selection counter 40 and return it to the $Q_0$ terminal.

The operator now actuates the digit selection switch 126 four times for the digit 4. The actuation of the digit selection switch 126 four times changes the state of the digit selection flip-flop 61 four times. This action produces four pulses which are emitted over a conductor 145 to advance the digit selection counter 40 from the output terminal $Q_0$ to the output terminal $Q_4$. In so doing, a voltage is emitted through a matrix 146 and through a wiper of the switch 133 and is applied to an input terminal of the AND gate 151. The change of state of the flip-flop 52 applied a voltage to another input terminal of the AND gate 151. Now, the operator actuates the sequencing switch 125. This action changes the state of the sequencing flip-flop 56. In turn, the sequencing flip-flop 56 produces a pulse for conduction over the conductor n, which results in the sequencing counter 41 advancing from the output terminal $Q_3$ to the output terminal $Q_4$. In so doing, a voltage is applied to still another terminal of the AND gate 151 to cause the conduction of the AND gate 151. The conduction of the AND gate 151 changes the state of the flip-flop 53. The change of state of the flip-flop 53 applies a voltage to an input of an AND gate 152. If the operator had actuated the digit selection switch 126 a number of times other than four times, the AND gate 151 would not conduct and the flip-flop circuit 53 would not change its state. Consequently, the garage door would not open. A reset pulse is emitted by the sequencing flip-flop 56 through the OR gate 43 and over the conductor m to reset the digit selection counter 40 and return it to the $Q_0$ terminal.

The operator now actuates the digit selection switch 126 five times for the digit 5. The actuation of the digit selection switch 126 five times changes the state of the digit selection flip-flop 61 five times. This action produces five pulses which are emitted over a conductor 145 to advance the digit selection counter from the output terminal $Q_0$ to the output terminal $Q_5$. In so doing, a voltage is emitted through a matrix 146 and through a wiper of the switch 134 and is applied to an input terminal of the AND gate 152. The change of state of the flip-flop 53 applied a voltage to another input terminal of the AND gate 152. Now, the operator actuates the sequencing switch 125. This action changes the state of the sequencing flip-flop 56. In turn, the sequencing flip-flop 56 produces a pulse for conduction over the conductor n, which results in the sequencing counter 41 advancing from the output terminal $Q_4$ to the output terminal $Q_5$. In so doing, a voltage is applied to still another terminal of the AND gate 152 to cause the conduction of the AND gate 152. The conduction of the AND gate 152 changes the state of the flip-flop 54. The change of state of the flip-flop 54 applies a voltage to an input of an AND gate 153. If the operator had actuated the digit selection switch 126 a number of times other than five times, the AND gate 152 would not conduct and the flip-flop circuit 54 would not change its state. Consequently, the garage door would not open. A reset pulse is emitted by the sequencing flip-flop 56 through the OR gate 43 and over the conductor m to reset the digit selection counter 40 and return it to the $Q_0$ terminal.

The operator now actuates the digit selection switch 126 six times for the digit 6. The actuation of the digit selection switch 126 six times changes the state of the digit selection flip-flop 61 six times. This action produces six pulses which are emitted over a conductor 145 to advance the digit selection counter from the output terminal $Q_0$ to the output terminal $Q_6$. In so doing, a voltage is emitted through a matrix 146 and through a wiper of the switch 135 and is applied to an input terminal of the AND gate 153. The change of state of the flip-flop 54 applied a voltage to another input terminal of the AND gate 153. Now, the operator actuates the sequencing switch 125. This action changes the state of the sequencing flip-flop 56. In turn, the sequencing flip-flop 56 produces a pulse for conduction over the conductor n, which results in the sequencing counter 41 advancing from the output terminal $Q_5$ to the output terminal $Q_6$. In so doing, a voltage is applied to still another terminal of the AND gate 153 to cause the conduction of the AND gate 153. The conduction of the AND gate 153 changes the state of the flip-flop 55. If the operator had actuated the digit selection switch 126 a number of times other than six, the AND gate 153 would not conduct and the flip-flop circuit 55 would not change its state. Consequently, the garage door would not open. A reset pulse is emitted by the sequencing flip-flop 56 through the OR gate 43 and over the conductor m to reset the digit selection counter 40 and return it to the $Q_0$ terminal. The change of state of the flip-flop 55 applies a voltage from the Q output terminal thereof to one side of an AND gate 160. The operator actuates the sequencing switch 125. As a consequence thereof, the sequencing flip-flop 56 emits a pulse so that an output voltage is present on the output terminal $Q_7$ of the sequencing counter 41. The voltage on the output terminal $Q_7$ is applied to the other input side of the AND gate 160 to cause the AND gate 160 to conduct. A pulse from the AND gate 160 is conducted over the conductor r, the conductor d, the conductor k, and is applied to the flip-flop 15 to change its state.

The change of state of the flip-flop 15 causes the transistor 30 to conduct in a manner previously described and also to change the state of the flip-flop 35 in a manner previously described. The change of state of the flip-flop 35 causes the transistor 36 to conduct in a manner heretofore described. The conduction of the transistor 30 and the transistor 36 energizes the relay 80. The energization of the relay 80 results in the opening of the garage door.

The flip-flop circuits 50–55 and the AND gates 141, 147, and 150–153 may be considered as a comparison circuit. If there is a match between the preselected code and the selected digits, the relay 80 operates. If there is a mismatch, the relay 80 remains deenergized.

The digit selection counter 40 is reset by the voltage on the Q output of the flip-flop 35 over the following path: flip-flop 35, conductor 21, conductor b, OR gate 42, OR gate 43, conductor m and counter 40. The sequence counter 41 is reset over the following path: Q output of flip-flop 35, conductor 21, conductor b, OR gate 42, conductor 1, and sequence counter 41.

Should the sequence counter 41 advance to output $Q_7$ and the flip-flop circuit 55 has not changed its state because of a wrong code selection, then an AND gate 161 conducts from the application of the $\bar{Q}$ output voltage from the flip-flop 55 and the voltage on the output $Q_7$ of the sequence counter 41. The conduction of the AND gate 161 changes the state of the flip-flop 57. The pulse emitted by the flip-flop 57 resets and latches the sequence counter 41 to $Q_0$.

Should the sequence counter 41 advance to output $Q_8$ and a digit selection pulse is emitted from the digit selection flip-flop 61, then an OR gate 162 will conduct. Should the flip-flop 55 have changed its state and the OR gate 162 is conducting, then an AND gate 163 will conduct to change the state of the flip-flop 57. The change of the state of the flip-flop 57 resets and latches the sequence counter 40 to $Q_0$. Should the sequence switch 125 be actuated, an AND gate 165 will conduct to change the state of the flip-flop 57 to reset and latch the sequence counter 41 to $Q_0$. The change of state of the flip-flop 35 via its Q output will reset the flip-flops 56, 57 and 61 over the following paths: flip-flop 35, conductor 21, conductor b, OR gate 42, conductor 59, conductor 60 and conductor 62.

Illustrated in FIG. 1 is a circuit 174 for automatically closing the garage door in the event the garage door is opened by means other than the circuit 10. When the circuit 10 is in the stand-by state with the garage door opened through the operation of the circuit 10, the switch 81 is opened and the output of a NAND gate 175 is at a "1" output or at a high voltage. When the NAND gate 175 is at a "1" output, a transistor 176 conducts. A capacitor 177 is held at a ground potential and the output of an AND gate 178 is "0" or at a low voltage. Thus, the flip-flop 15 does not change its state and the relay 80 is deenergized. Hence, the garage door does not close.

Should the garage door open by means other than the circuit 10, the switch 81 (FIG. 3) is closed. Both input terminals of the NAND gate 175 is at a "1" voltage or a high voltage and the NAND gate 175 conduct. The output of the NAND gate 175 is at a low voltage or "0" voltage. The transistor 176, therefore, does not conduct. This action allows the capacitor 177 to charge. The capacitor 177 charges over a path including a resistor 180.

When the capacitor 177 is fully charged, the output of the AND gate 178 is set at a high voltage or "1". Thereupon, the flip-flop 15 changes its state and the relay 80 is energized in a manner heretofore described in detail to close the garage door automatically.

As the door begins to close, the AND gate 83 conducts because of the change of state of the flip-flop 35 in a manner heretofore described in detail. The conduction of the AND gate 83 changes the state of a flip-flop 181. The change of state of the flip-flop 181 causes the output of the NAND gate 175 to be at a high voltage or a "1", since the NAND gate 175 does not conduct. The transistor 176 conducts to discharge the capacitor 177.

After the garage door has closed, the switch 81 is opened. The NAND gate 175 does not conduct and the transistor 176 does conduct. The discharge of the capacitor 177 triggers a monostable multivibrator 182. The triggering of the multivibrator 182 produces a pulse to reset the flip-flop circuit 181 to its stand-by mode.

If the garage door is opened through the circuit 10, the flip-flop circuit 181 is a set state by "1" or high voltage output of the AND gate 83. The $\bar{Q}$ terminal of the flip-flop circuit 181 has a "0" voltage output or a low voltage output. The NAND gate 175 now has a "0" voltage or low voltage output. The transistor 176 conducts and is held in a conducting state. Each side of the capacitor 177 is held at ground regardless of the condition of the garage door. Therefore, the automatic door closing circuit 174 is disabled.

I claim:

1. A circuit for controlling the operation of a garage door or the like through the activation of a garage door device or similar device comprising:

(a) means for activating the garage door device;

(b) a counting circuit including a timing circuit for activating said means in response to receiving a predetermined number of pulses within a predetermined time period; and (c) switch means connected to said counting circuit for sending said predetermined number of pulses within said time period to said counting circuit for operating said garage door device.

2. A circuit as claimed in claim 1 wherein said switch means includes a manually operated switch.

3. A circuit as claimed in claim 2 wherein said switch means includes a switch actuated by the movement of a vehicle.

4. A circuit as claimed in claim 2 wherein said counting circuit is operative for activating said means in response to receiving an even number of pulses.

5. A circuit as claimed in claim 3 wherein said counting circuit is operative for activating said means in response to receiving an even number of pulses.

6. A circuit as claimed in claim 4 wherein said counting circuit is an even count flip-flop circuit.

7. A circuit as claimed in claim 5 wherein said counting circuit is an even count flip-flop circuit.

8. A circuit as claimed in claim 2 wherein said timing circuit is a resistance-capacitance time delay network.

9. A circuit as claimed in claim 1 and comprising signal means connected to said means for activating the garage door device for an alert state when said means activates the garage door device.

10. A circuit as claimed in claim 1 and comprising:

(a) a switch actuated in response to the opening of a garage door; and (b) signal means operated in response to the actuation of said switch for an alert state to the opening of the garage door.

11. A circuit as claimed in claim 10 wherein said signal means comprises an oscillator producing a plurality of signals at different frequencies, said oscillator producing one frequency signal in response to the actuation of said switch for an alert state to the opening of the garage door.

12. A circuit as claimed in claim 11 wherein said signal means is connected to said means for activating the garage door device for operating said oscillator to produce another frequency signal for an alert state when said means activates the garage door device.

13. A circuit as claimed in claim 11 wherein said signal means includes an alarm producing different frequency sounds for the various frequency signals.

14. A circuit for controlling the operation of a garage door or the like through the activation of a garage door device or similar device comprising:

(a) first means for activating and deactivating the garage door device;

(b) code selective means for registering a predetermined digital code;

(c) operator actuated switching means including digit selection means operable by an operator to select digital signals;

(d) a comparison circuit connected to said code selective means and said operator actuated switching means for comparing said digital code with said selected digital signals, said comparison circuit being connected to said first means to activate said first means in response to digital signals matching said digital code; and (e) a sequencing circuit activated by an operator and connected to said comparison circuit for coordinating through said comparison circuit the comparison of said digit code with said selected digital signals for each digit respectively.

15. A circuit as claimed in claim 14 wherein said code selective means comprises presettable switches, each switch being preset to register a digit of said digital code.

16. A circuit as claimed in claim 15 wherein said comparison circuit comprises a series of flip-flop circuits, a gate circuit associated with each flip-flop circuit of said series of flip-flop circuits, each of said gate circuits interconnecting one of said presettable switches and its associated flip-flop circuit.

17. A circuit as claimed in claim 16 wherein said operator actuated switching means comprises a digit selection counter, a matrix interconnecting said digit selection counter and said presettable switches, said gate circuits having input voltages applied thereto in accordance with the digital state of said digit selection counter.

18. A circuit as claimed in claim 17 wherein said operator actuated switching means includes a pulse producing circuit interconnecting said digit selection means and said digit selection counter for applying pulses to said digit selection counter in response to the operation of said digit selection means for setting said digit selection counter in the digital state representative of a digit selected by said digit selection means.

19. A circuit as claimed in claim 18 wherein said sequencing circuit comprises a sequencing counter connected to said gate circuits, said gate circuits having input voltages applied thereto in accordance with the state of said sequence counter.

20. A circuit as claimed in claim 19 wherein said operator actuated switching means includes a pulsing circuit for applying pulses to said sequencing counter to change the state thereof at the completion of each comparison between a digit of said digit code and a digital signal of said selected digital signal.

21. A circuit as claimed in claim 20 wherein said flip-flop circuits change their respective states in succession in response to the conduction of the gate circuit associated therewith, said gate circuits conduct in succession in response to a match successive digits of said digit code and digital signals of successively selected digits and the successive operation of said sequencing counter.

22. A circuit as claimed in claim 21 wherein gate circuits connected to the output of said flip-flop circuits conduct in response to the change of state of the flip-flop circuit to which there is a connection to the output thereof.

23. A circuit for controlling the operation of a garage door or the like through the activation of a garage door device or similar device comprising:

(a) a garage door;

(b) a garage door device for opening and closing said garage door;

(c) first means connected to said garage door device for activating the garage door device; and (d) second means connected to said first means for activating said first means to activate the garage door device for closing the garage door when the garage door opens during inaction of said first means, said second means being disabled in response to said first means being activated for activating said garage door device to open said garage door.

24. A circuit as claimed in claim 23 wherein said first means sends a signal to said second means during the activation of said first means for activating the garage door device to disable said second means.

25. A circuit as claimed in claim 24 wherein said first means includes a switch activated by the opening of the garage door to activate said second means to activate said first means for activating said garage door device to close the garage door.

* * * * *